US010751564B2

(12) United States Patent
Unsworth

(10) Patent No.: US 10,751,564 B2
(45) Date of Patent: Aug. 25, 2020

(54) CROSS-COUNTRY SKI EXERCISE MACHINE

(71) Applicant: Brett Unsworth, Toronto (CA)

(72) Inventor: Brett Unsworth, Toronto (CA)

( * ) Notice: Subject to any disclaimer, the term of this patent is extended or adjusted under 35 U.S.C. 154(b) by 47 days.

(21) Appl. No.: 15/892,896

(22) Filed: Feb. 9, 2018

(65) Prior Publication Data

US 2019/0247710 A1 Aug. 15, 2019

(51) Int. Cl.

| | |
|---|---|
| ***A63B 22/20*** | (2006.01) |
| ***A63B 21/00*** | (2006.01) |
| ***A63B 21/02*** | (2006.01) |
| ***A63B 22/00*** | (2006.01) |

(52) U.S. Cl.

CPC ..... *A63B 22/203* (2013.01); *A63B 21/023* (2013.01); *A63B 21/152* (2013.01); *A63B 21/154* (2013.01); *A63B 21/4011* (2015.10); *A63B 21/4017* (2015.10); *A63B 21/4034* (2015.10); *A63B 21/4035* (2015.10); *A63B 22/0046* (2013.01)

(58) Field of Classification Search

CPC ..... A63B 23/1263; A63B 69/182; A63B 21/00185; A63B 21/12; A63B 21/018; A63B 21/16; A63B 21/225; A63B 21/4034; A63B 21/154; A63B 21/152; A63B 21/4035; A63B 21/4017; A63B 21/4011; A63B 21/023; A63B 22/0002; A63B 22/001; A63B 22/0012; A63B 22/201; A63B 22/203; A63B 22/0046

See application file for complete search history.

(56) References Cited

U.S. PATENT DOCUMENTS

| | | | | |
|---|---|---|---|---|
| 4,023,795 A | | 5/1977 | Pauls | |
| 4,659,077 A | | 4/1987 | Stropkay | |
| 4,709,918 A | * | 12/1987 | Grinblat | A63B 21/012 482/118 |
| 4,728,102 A | * | 3/1988 | Pauls | A63B 21/015 482/118 |
| 5,387,168 A | * | 2/1995 | Bostic | A63B 22/0012 482/139 |

(Continued)

OTHER PUBLICATIONS

Nordic Academy. "Nordic Walking Video on Treadmill with Resistance Bands." YouTube, Oct. 20, 2013, https://www.youtube.com/watch?v=mwKLObTDDfo 1:16.

(Continued)

*Primary Examiner* — Michael C McCullough
(74) *Attorney, Agent, or Firm* — Perry + Currier Inc.

(57) ABSTRACT

A cross country skiing exercise machine is disclosed. The machine has ski members slidingly mounted to a base frame and front and rear arm exercise units mounted towards the front and rear of the base frame, respectively. The front arm exercise unit has a front pair of flexible lines to be gripped by a user's hands to permit the user to reciprocally pull back on said front pair of flexible lines. The rear arm exercise unit has a rear pair of flexible lines having straps configured to be attached to the user's arms to permit the user to reciprocally pull forward on the rear pair of flexible lines. The front and rear arm exercise units are configured to apply a drag force to the front and rear pair of flexible lines, respectively. A rear leg exercise unit having flexible lines for mounting to the user's legs is also provided.

22 Claims, 8 Drawing Sheets

(56) References Cited

U.S. PATENT DOCUMENTS 5,643,153 A * 7/1997 Nylen ..... A63B 21/015 482/110
5,695,433 A * 12/1997 Buisman ..... A63B 22/0012 482/70
6,042,516 A * 3/2000 Norton ..... A63B 22/0002 482/54
6,123,649 A * 9/2000 Lee ..... A63B 21/153 482/51
6,302,829 B1 * 10/2001 Schmidt ..... A63B 21/0058 482/51
6,652,427 B2 * 11/2003 Wroclawsky ..... A63B 22/02 482/111
6,837,830 B2 * 1/2005 Eldridge ..... A63B 21/157 482/54
7,775,936 B2 * 8/2010 Wilkinson ..... A63B 22/0005 482/51
8,075,453 B1 * 12/2011 Wilkinson ..... A63B 22/0005 482/51
9,737,760 B2 * 8/2017 Harrer ..... A63B 21/0552
10,220,261 B1 * 3/2019 Garsdean ..... A63B 24/0087
2002/0086779 A1 * 7/2002 Wilkinson ..... A63B 21/00069 482/118
2004/0043873 A1 * 3/2004 Wilkinson ..... A63B 21/015 482/54
2004/0087418 A1 * 5/2004 Eldridge ..... A63B 21/157 482/54

OTHER PUBLICATIONS

H/P/Cosmos. "h/p/Cosmos Mercury Med Treadmill Sticker Application Neurorehabilitation." YouTube, Feb. 15, 2010, https://www.youtube.com/watch?v=f3b6BN-ThnU&feature=youtu.be&t=69 2:04.
H/P/Cosmos. "h/p/Cosmos Robowalk Expander Exercise with Lamar Lowery.", YouTube, Mar. 7, 2012, https://www.hpcosmos.com/en/products/sports-fitness/functional-training. 0:56 Retrieved from the Internet: https://www.youtube.com/watch?v=RV5lkam-I10.
H/P/Cosmos. "Athletic Training on h/p/Cosmos Treadmill with Robowalk Expander." YouTube, Aug. 5, 2014, https://www.youtube.com/watch?v=2FzJhS7yu6o&feature=youtu.be&t=243 9:09.

* cited by examiner

Prior Art: NORDICTRACK™ Ski Machine

CROSS-COUNTRY SKI EXERCISE MACHINE

CROSS-REFERENCE TO RELATED APPLICATION

This application claims priority from U.S. Provisional application 62/459,702 filed Feb. 16, 2017 and which is incorporated herein.

BACKGROUND OF THE INVENTION

The present invention is directed to exercise equipment and, more particularly, to a cross-country skiing exercise apparatus with customizable workouts for additional groups of muscles.

In the history of exercise machines, the NORDICTRACK™ cross-country ski machine has been one of the most successful, with wide-spread adoption and a faithful following among its user base. The NORDICTRACK™ ski machine is built to imitate the motions through which a human body goes when cross-country skiing, an exercise widely considered an excellent cardiovascular workout.

There are several models of NORDICTRACK™ ski machines, but they all work on the same basic concept: the user places his/her feet on platforms (skis) which slide back and forth on rails. At the same time there are hand grips attached to cables that simulate the movement of cross country ski poles. In most models, the user can adjust the resistance of both the rails the platforms ride on (simulating skis) and arm grips (simulating poles) to increase the intensity of the workout.

The inventor found that, for himself, the primary shortcoming of the NORDICTRACK™ cross—country ski machine was a tendency to create muscle fatigue and joint pain in the area of the shoulder. Further, the inventor found that on a prior art NORDICTRACK™ ski machine, no variation in hand position or angle/range of the upper body pulling motion alleviated this pain. Additionally, this shoulder pain reoccurred rapidly upon resumption of training on this machine at a later date.

The prior art NORDICTRACK™ ski machine is, in its essence, limited to low intensity steady state (cardiovascular) training and is unsuitable for Anaerobic (Lactate) Threshold Training or High Intensity Interval Training (HIIT), both of which incorporate much higher exertion levels.

The prior art NORDICTRACK™ ski machine also causes an unbalanced training effect on the upper body, resulting in a less structurally sound shoulder girdle and musculature. When using the NORDICTRACK™ ski machine, the arms execute a predominately "pulling back" motion against a resistance, whereas the legs perform predominantly a "pushing back" motion. The NORDICTRACK™ ski machine lacks a way to engage the arms with a "pushing forward against a resistance" motion, and does not offer a "leg pushing forward against a resistance" motion. Lastly, the NORDICTRACK™ ski machine suffers from lack of flexibility: if one desires to use it for an intense cardio workout, one cannot select which muscle group to "exert" and which muscle group to "spare". For example, an athlete whose sport places greatest demands on the lower body, like most team sports, and who wants to get some "cardio" training can only turn down the resistance on the legs (skis) so much before the overall cardiovascular demand of the exercise drops to insignificance. Alternatively, if the athlete lifts weights or rows etc., they would be unable to "spare" the back if it was fatigued from a recent workout There is an unmet need in the market for a machine which would improve upon a NORDICTRACK™ ski machine, for a machine that would allow users to isolate and selectively exercise (or barely exercise at all, if so desired) different body areas and different muscle groups, without undue stress on those muscle groups to which the user may want to allow some rest and recovery after prior heavy use, and enabling if so desired, a much higher intensity cardio workout.

SUMMARY OF THE INVENTION

The present invention responds to this unmet need in the market by introducing functional improvements to a prior art NORDICTRACK™ ski machine, so as to allow users to isolate and selectively exercise (or barely exercise at all, if so desired) different body areas and different muscles groups. The present invention consists of an exerciser for simulating cross country skiing and includes a base frame having opposite forward and rear ends. A pair of ski members is mounted to the base frame with the ski members and base frame configured to permit the ski members to slide back and forth between the first and second ends by overcoming a first drag force. A front post extends upwardly from the forward end of the base frame. A forward arm exercise unit having a pair of flexible lines is mounted to the front post, each of the forward pair of flexible lines having handles to be gripped by a user's hands to permit the user to reciprocally pull back on the first pair of flexible lines. The forward arm exercise unit is configured such that a second drag force is applied to the first pair of flexible lines resisting the rearward movement of said forward pair of flexible lines. The exerciser further includes a rear post extending upwardly from the rear end of the base frame. A rear arm exercise unit having a rear pair of flexible lines is mounted to the rear post. The rear pair of flexible lines have straps configured to be attached to the user's arms to permit the user to reciprocally pull forward on the rear pair of flexible lines. The rear arm exercise unit is configured to apply a third drag force to the rear pair of flexible lines resisting the forward movement of said rear pair of flexible lines. The ski members are mounted between the forward and rear posts such that the user is positioned between the front and rear posts when the user mounts the ski members. Additionally, a second, rear leg exercise unit similar to the rear arm exercise unit can also be mounted to the rear post to provide a "push forward" motion to the leg.

BRIEF DESCRIPTION OF THE DRAWINGS

The novel features which are believed to be characteristic of the present invention, as to its structure, functionality, use and method of operation, together with further objectives and advantages thereof, will be better understood from the following drawings in which a presently preferred embodiment of the invention will now be illustrated by way of example. It is expressly understood, however, that the following drawings are for the purpose of illustration and description only, and are not intended as a definition of the limits of the invention. In the accompanying drawings.

DETAILED DESCRIPTION OF THE INVENTION

The machine made in accordance with the present invention is a cross-country skiing machine which builds upon and improves upon the Prior Art NORDICTRACK™ ski machines disclosed in: U.S. Pat. No. 4,023,795 to inventor Edward A. Pauls (the founder of NORDICTRACK™ ski machine); U.S. Pat. No. 4,728,102 to same inventor Edward A. Pauls; U.S. Pat. No. 4,659,077 to inventor Edward J. Stropkay (1985), for an alternative cross—country ski machine; and U.S. Pat. No. 5,387,168 to inventor James R. Bostic, covering improvements to the NORDICTRACK™ cross—country ski trainer. To the extent that the patents listed above facilitate understanding of the present invention, such patents are incorporated herein by reference.

Figure 1:
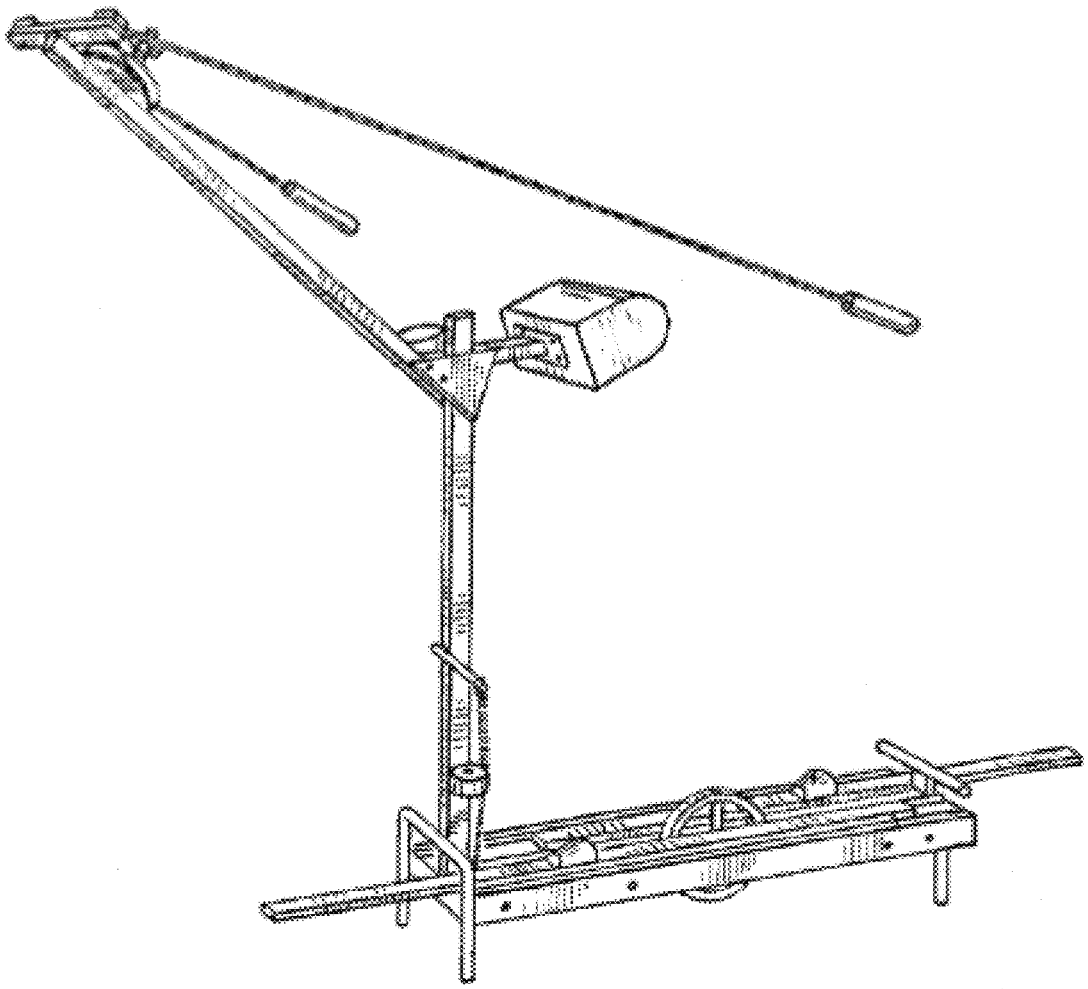
FIG. 1 is a drawing of a typical prior art NORDICTRACK™ ski machine of the type that is to be used as the foundation for the improvements brought about by the present invention.

Generally, a prior art NORDICTRACK™ ski machine, as shown in the enclosed FIG. 1 and consists of:

- a horizontal base frame with short legs which rest upon a floor surface;
- a pair of simulator ski members slidably mounted relative to the base frame;
- ski resistance means, operatively connected to the base and to the skis, which in a preferred embodiment may consist of a flywheel and a drag strap;
- a front post mounted on the base, which front post extends in a substantially vertical direction from the base when in an operable position;
- a pelvis support (hip pad) secured to the front post whereby the elevation of the pelvis support is adjustable along the front post to accommodate persons of various heights;
- a front arm secured to the front post, extending in a forward and upward direction from the front post when in an operable position, defining an angle of approximately 130 degrees between the front bar and the front post;
- a front arm exercise unit mounted at the distal end of the front bar; the front arm exercise unit includes a hub which couples to a pair of front flexible lines designed to be pulled from a pulley on the hub in reciprocating fashion, subject to a frictional resistance or drag force, and
- a pair of free handles is mounted at the distal ends of the front flexible lines.

When operating the prior art NORDICTRACK™ ski machine, a person faces toward the pelvis support, places a foot on each of the ski members, and leans forward slightly to rest his or her pelvis or hips against the pelvis support. The person may additionally grasp a free handle in each hand. The person then "shuffles" his or her feet back and forth, alternately pushing one of the skis rearward against the resistance from the flywheel and pulling the other of the skis forward subject to minimal resistance. The user also has the option of alternately pulling one of the free handles rearward against the resistance from the pulley and having the other of the free handles reciprocally pulled forward.

Figure 2:
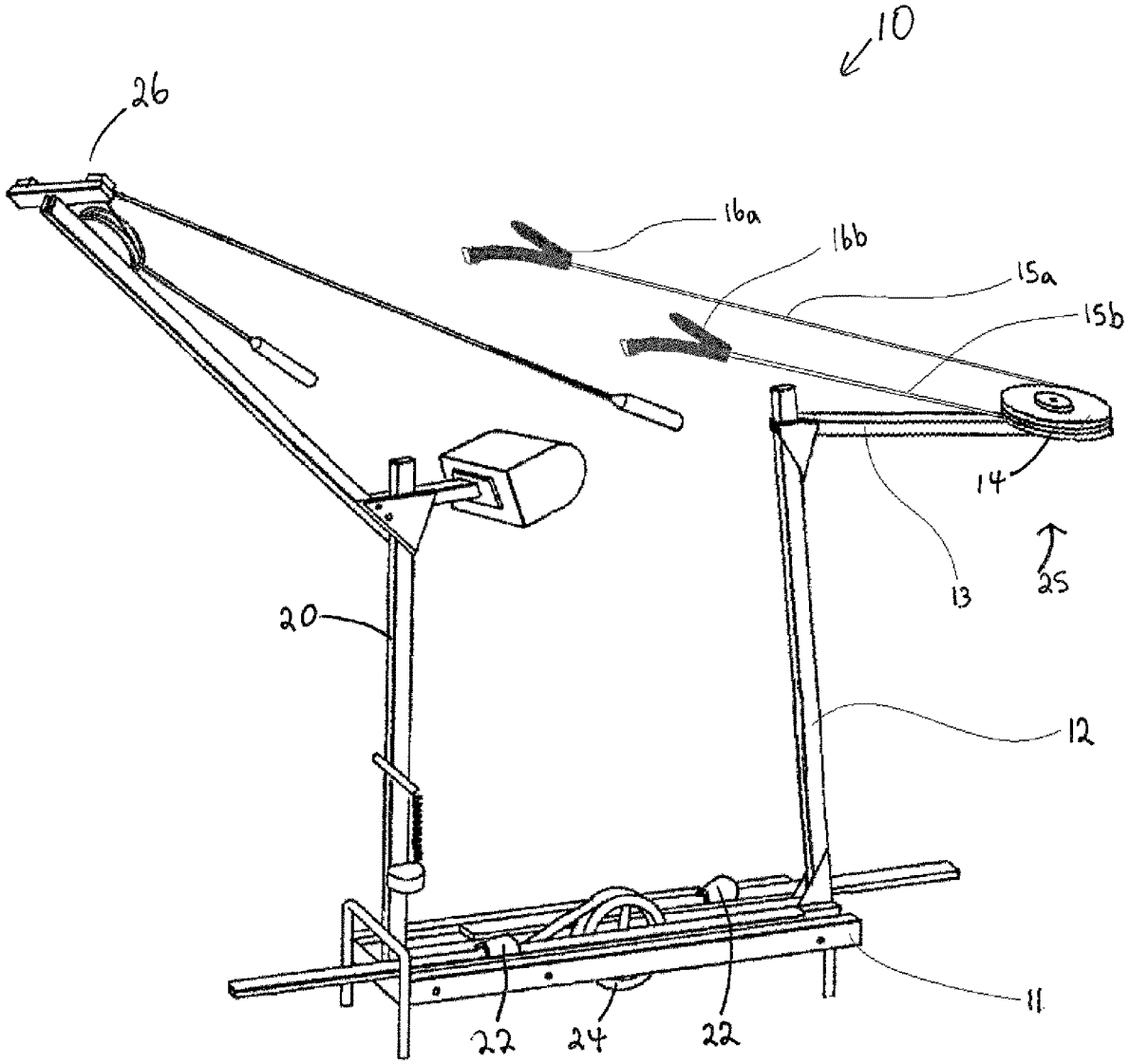
FIG. 2 is a perspective view of a machine according to a preferred embodiment of this invention.

According to a preferred embodiment of this invention as seen as item 10 in FIG. 2, an additional rear post 12 is attached to the rear end of the base frame 11 of the machine. While the rear post extends preferentially in a substantially vertical direction from the base frame, the angle between the rear post and the base is preferably user configurable, allowing the user to select an angle which provides a customized level of comfort. A rear arm 13 is secured to the rear post, extending in a rearward direction from the rear post when in an operable position. The angle between the rear arm and the rear post is preferably user configurable, allowing the user to select an angle which provides a customized level of comfort. In a further preferred embodiment of this invention, the height of the rear post or the height at which the rear arm branches from the rear post may also be user configurable, allowing the user to select a height which provides a customized level of comfort.

According to a preferred embodiment of this invention, a resistance member 14 (or any other known resistance means) is mounted at the distal end of the rear arm, fitted with an elongated flexible line 15 which is spooled onto resistance member 14 to form separate line portions 15*a* and 15*b* each having an end. The elongated flexible line is partially spooled or looped onto the pulley much like a rope is spooled onto a pulley. When spooled onto the pulley, the single elongated line essentially forms two separate lines 15*a* and 15*b*, each of which can be pulled forward from the rear resistance member, subject to a pulling drag force.

The base frame 11 and the front part of the machine are similar to the corresponding parts of a prior art NORDICTRACK™ ski machine. A pair of ski members 22 are mounted to base frame 11 and are operatively coupled to resistance member 24 such that when the user shuffles the ski members back and forth, resistance member 24 imparts a first drag force onto the ski members. Resistance member 24 may consist of a fly wheel and drag strap combination as found in traditional Nordic Track devices where the fly wheel is made to spin by shuffling the ski members and the drag strap applies additional resistance to the spinning of the wheel. According to the embodiment of this invention depicted in FIG. 2, a rear post 12 is attached to the rear end of the base 11 of the machine, at a sufficient distance from the front post 20 so as to allow a full ski stride for a user positioned therebetween. While the rear post 12 extends preferentially in a substantially vertical direction from the base 11, the angle between the rear post and the base is preferably user configurable, allowing the user to select an angle which provides a customized level of comfort.

Also shown in FIG. 2 is the rear arm (bar) 13, secured to the rear post 12 near the top of the rear post 12, and extending in a rearward direction from the rear post 12 when in an operable position. The angle between the rear arm 13 and the rear post 12 is preferably user configurable, allowing the user to select an angle which provides a customized level of comfort.

A rear arm exercise unit 25 is mounted at a distal end of rear arm 13. Rear arm exercise unit 25 may be any form of exercise unit such as a pulley or clutch, or any other known resistance means, whether friction based, or mechanical, magnetic, pneumatic, hydraulic, electric, etc. Preferably, rear arm exercise unit 25 consists of a resistance member engaging with a flexible line for imparting a drag force onto the line. Ideally, the resistance member consists of a pulley 14 which is fitted with an elongated flexible line 15 to form a pair of rear flexible lines 15*a* and 15*b* designed to be pulled from the rear resistance pulley 14, subject to a second drag resistance force. A pair of rear VELCRO™ Hook and Eye straps 16*a* and 16*b* (or any other known attachment means) is mounted at the distal ends of the rear flexible lines 15*a* and 15*b*, so as to allow the ends of the two rear flexible lines to be attached to various parts of the user's upper body (arms, elbows, forearms, wrists, hands, etc.). In a preferred embodiment, the rear resistance pulley 14 is fitted with means for adjusting the level of resistance or friction, so as to offer an adjustable pulling force to rear flexible lines 15*a* and 15*b*. Rear arm exercise unit 25 may consist of a pulley mechanism otherwise identical in structure as forward arm exercise unit 26 as found in prior art NORDICTRACK™ machines.

In a further preferred embodiment of this invention, the overall height of the rear post 12 or the height at which the rear arm 13 branches from the rear post 12 may also be user configurable, allowing the user to select a height which provides a customized level of comfort. The inventor has found, unexpectedly, that a very advantageous and comfortable configuration for a user is effected when the rear resistance pulley 14, the rear flexible lines 15*a* and 15*b*, the attachment points to the user's body (e.g. upper arm, just above the elbow), the front flexible lines, and the front resistance pulley 26 are approximately in the same plane, or as close as possible to being in the same plane, or are in parallel planes. To achieve this configuration, it may be advantageous that rear post 12 should be tilted slightly forward from the vertical, with the rear bar 13 at an angle slightly below the horizontal.

Figure 3:
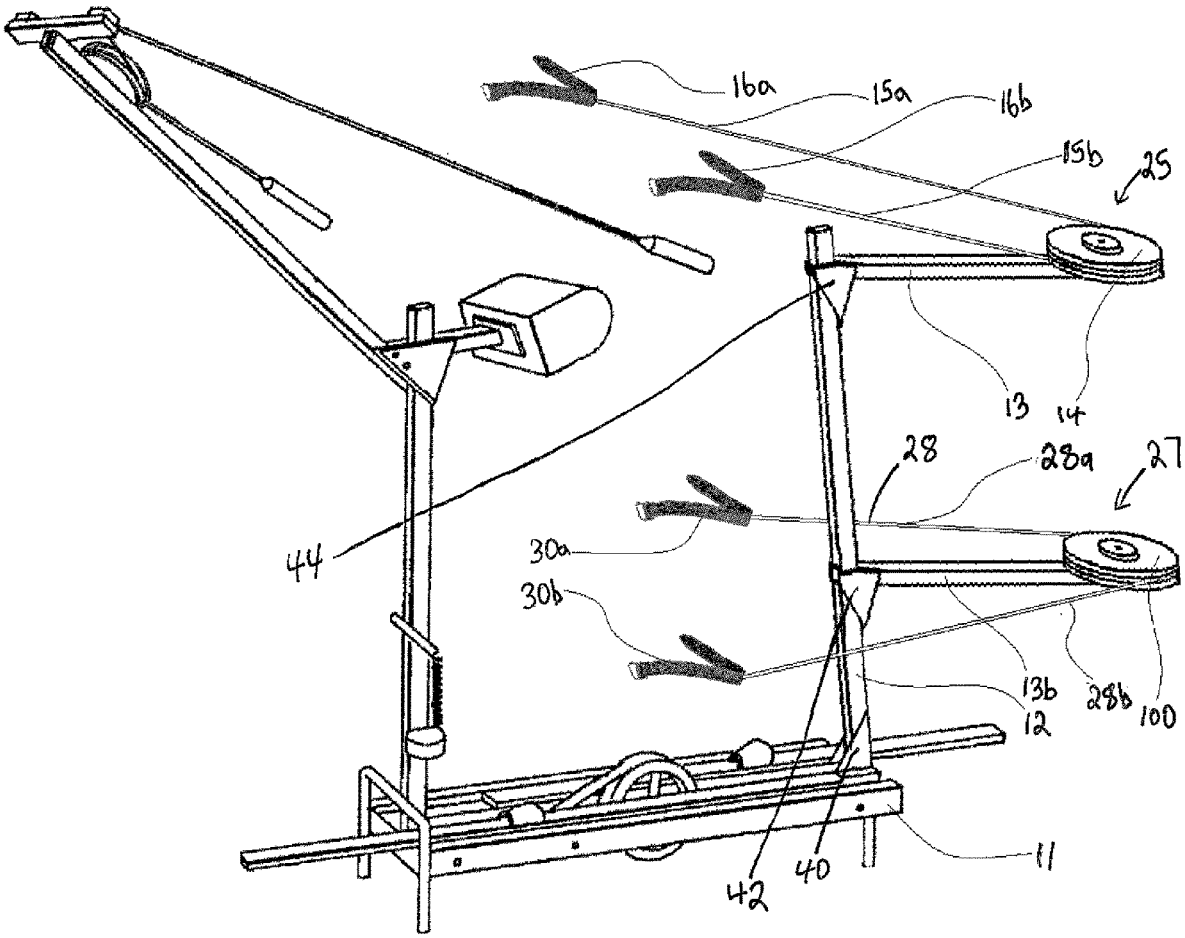
FIG. 3 is a perspective view of a machine according to a further preferred embodiment of this invention, whereby a second (lower) rear exercise unit is secured to the rear post, with a second rear resistance pulley and flexible lines mounted thereon, so as to offer two additional rear flexible lines to be attached to additional parts of the user's body (thighs, knees, calves, shins, ankles, shoes, etc.), offering additional adjustable resistance to the forward movement of the user's legs and feet.

In an optional embodiment of this invention, depicted in FIG. 3, a second (lower) rear arm 13*b* is secured to the rear post 12 along the lower portion of the rear post 12, and extending in a rearward direction from the rear post 12 when in an operable position. The angle between the lower rear arm 13*b* and the rear post 12 is preferably user configurable, allowing the user to select an angle which provides a customized level of comfort. Leg exercise unit 27 is provided at the end of arm 13*b* and is structurally similar to the rear arm exercise unit 25. Leg exercise unit 27 includes resistance member (pulley) 100 (or a clutch, or any other known resistance means, whether friction based, or mechanical, magnetic, pneumatic, hydraulic, electric, etc.) fitted with a second elongated flexible line 28 looped onto pulley 100 to form a pair of rear flexible lines 28*a* and 28*b* designed to be pulled from the rear resistance pulley 100, subject to a pulling resistance drag force. A pair of rear VELCRO™ Hook and Eye straps 30*a* and 30*b* (or any other known attachment means) is mounted at the distal ends of the rear flexible lines 28*a* and 28*b*, so as to allow the ends of the two rear flexible lines to be attached to various parts of the user's lower body (thighs, knees, calves, shins, ankles, shoes, etc.). The height at which the rear arm 13*b* branches from the rear post 12 may be preset or may also be user configurable, allowing the user to select a height which provides a customized level of comfort. In a preferred embodiment, the rear resistance pulley 100 is fitted with means for adjusting the level of resistance or friction, so as to offer an adjustable pulling force to rear flexible lines 28*a* and 286. For ease of construction, resistance member (pulley) 100 is substantially identical in structure to resistance member (pulley) 14.

Figure 6:
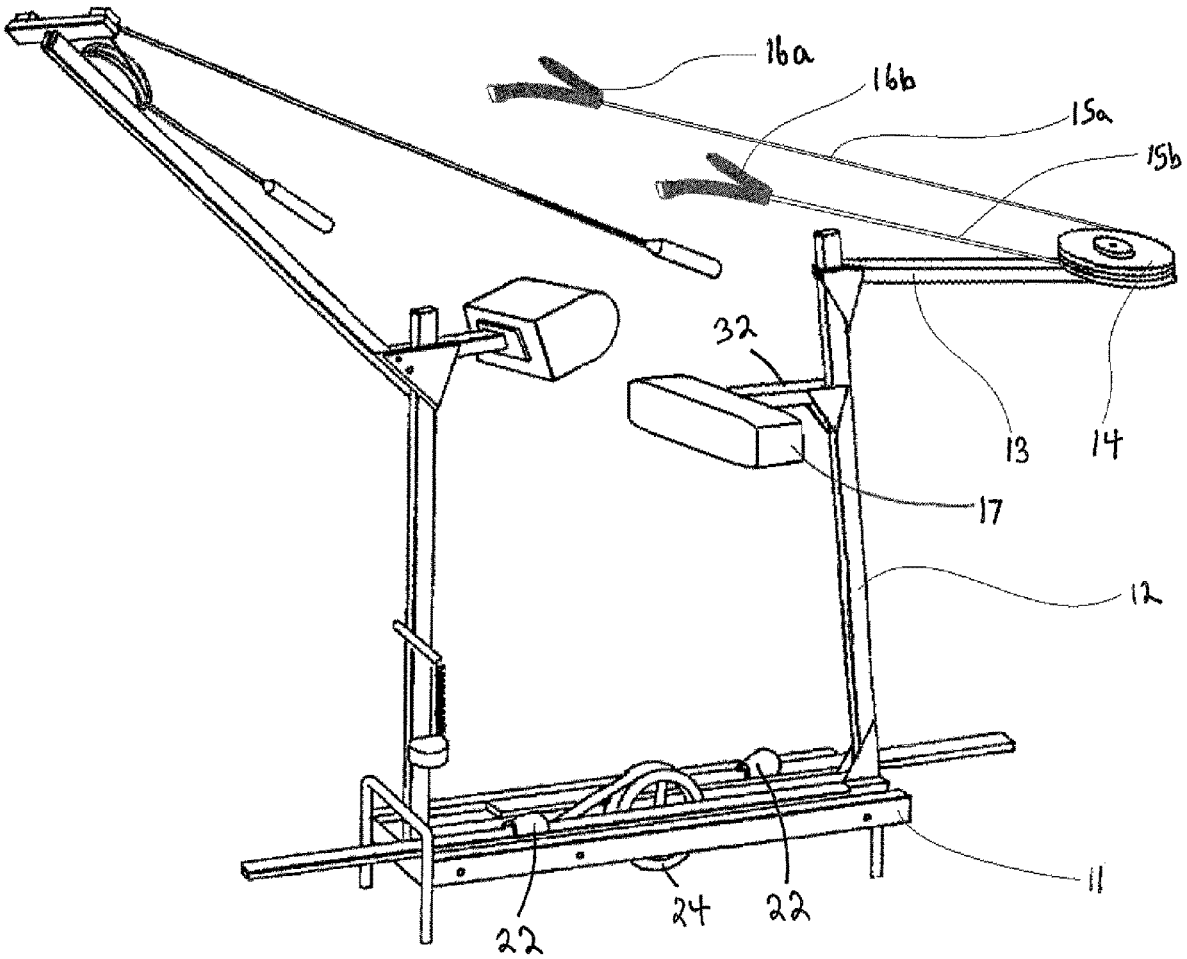
FIG. 6 is a perspective view of a machine according to an alternate preferred embodiment of this invention, showing the same machine from FIG. 2, but with an optional buttocks pad fitted to the rear post.
Figure 7:
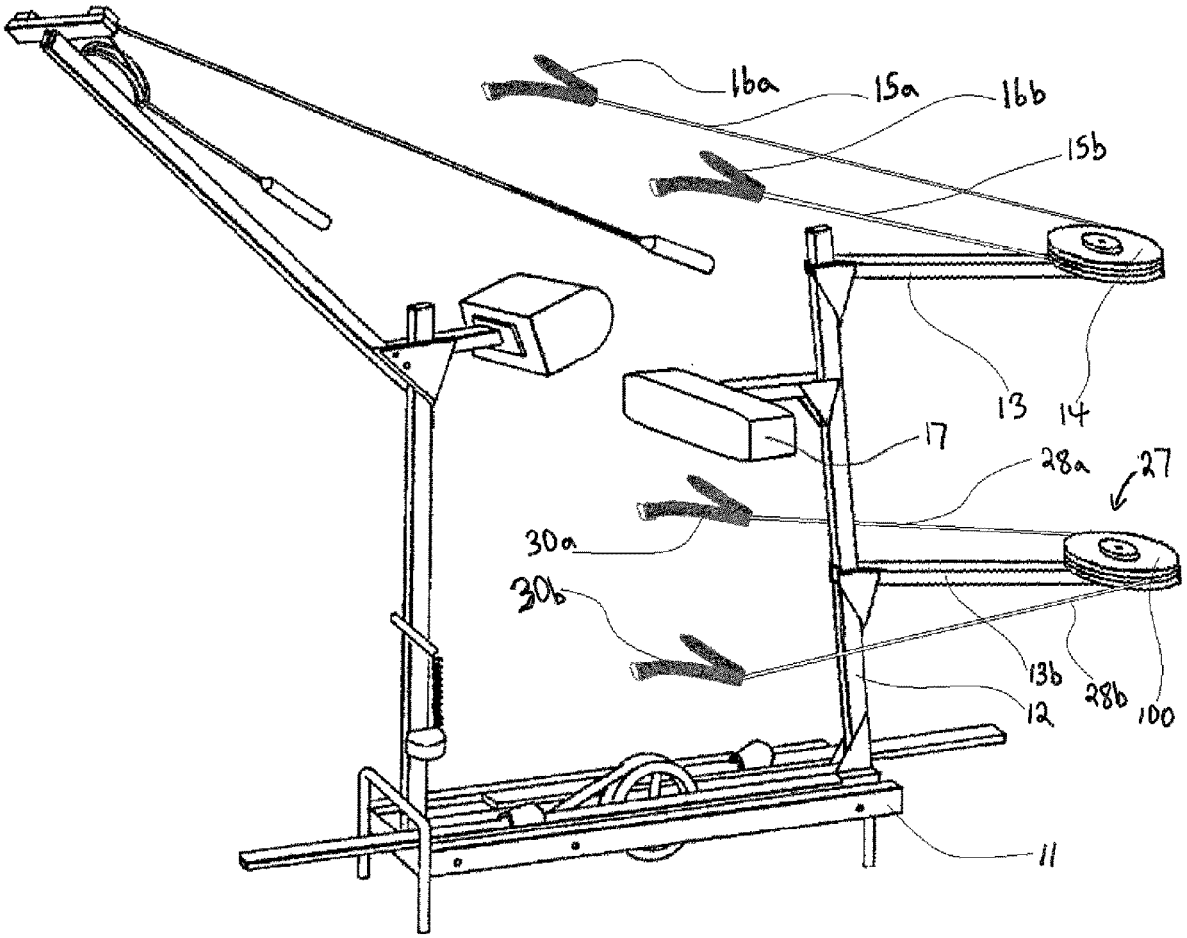
FIG. 7 is a perspective view of a machine according to an alternate preferred embodiment of this invention, showing the same machine from FIG. 3, but with a lower rear arm exercise unit attached.
Figure 8:
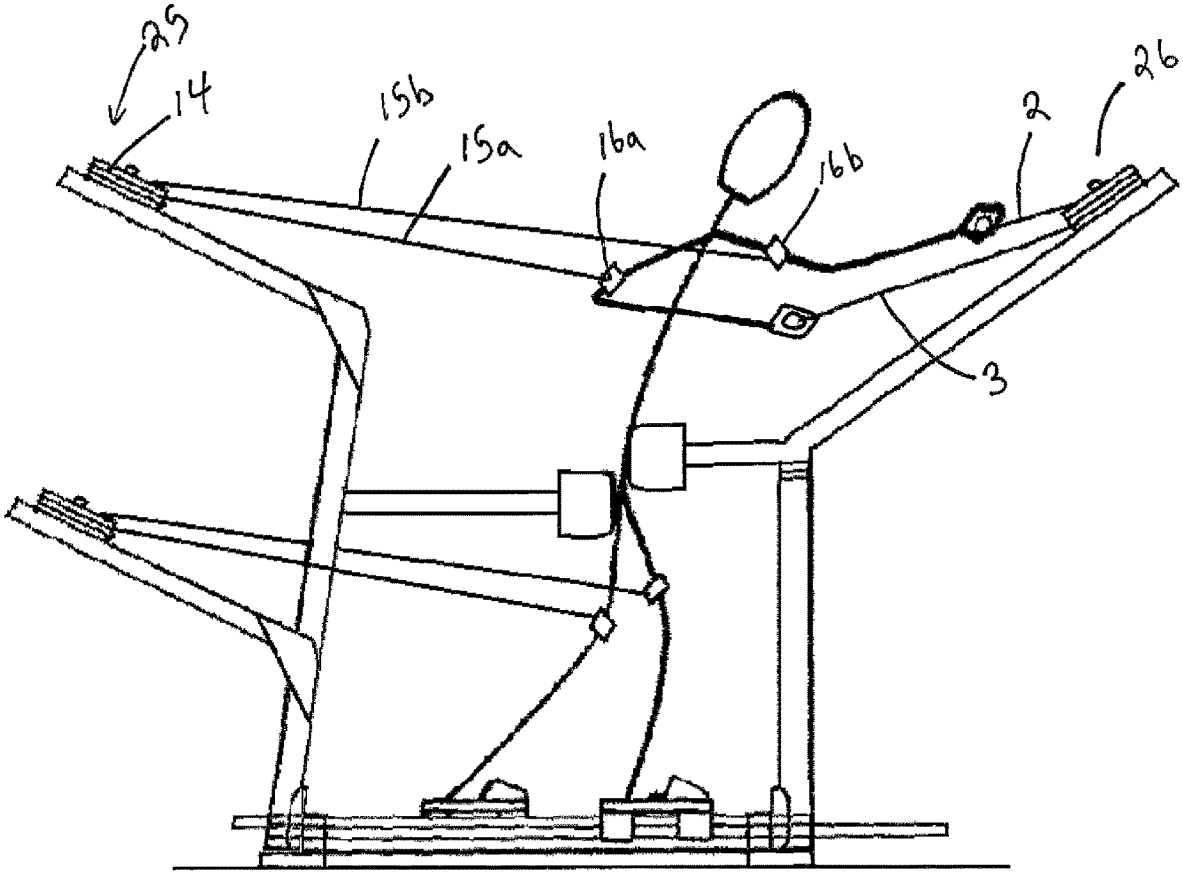
FIG. 8 is a schematic side view of a user using the same machine from FIG. 7, depicting the optional buttocks pad fitted to the rear post.

In further optional embodiments of this invention, depicted in FIGS. 6, 7 and 8, a buttocks pad 17 is secured to the rear post 12 along the upper portion of the rear post 12, via a buttocks bar 32 extending in a forward direction from the rear post 12 when in an operable position. The optional buttocks pad 17 provides additional support and stability to the user's buttocks when using the machine according to this invention, especially when the user is engaging the rear resistance pulleys. The height of the buttocks pad 17, as well as the distance and angle between the buttocks pad and the rear post 12 is preferably user configurable, allowing the user to select a buttocks pad position which provides a customized level of comfort and support. Referring specifically to FIG. 8, front exercise unit 26 is positioned to approximately align vertically with rear exercise unit 25 such that pulley 14 places flexible lines 15*a* and 15*b* at substantially the same vertical level as lines 3 and 2 of front exercise unit 26. The lengths of lines 312 and 15*a*/15*b* are selected such there is substantially no slack in lines 15*a*, 15*b*, 2 and 3 ensuring that when the user pulls back on line 3 while simultaneously pulling forward on line 15*b* (as illustrated in FIG. 8), line 2 and line 15*a* are simultaneously pulling forward and backward, respectively. By ensuring there is no slack in the lines, the device ensures that as the user pulls back on each arm it is simultaneously being pulled forward by the machine and each time the user pushes an arm forward the machine automatically applies a drag force pulling the same arm back. Hence, each arm is exercised both as it's pulled back and as it's pushed forward ensuring a more engaging workout.

In all embodiments of this invention described above, the resistance pulleys (front or upper rear or lower rear or any combination thereof) may be optionally selected from among (or replaced with) any known suitable means of effecting fixed or adjustable resistance, such as pneumatic means, hydraulic means, magnetic, electric, frictional, servo motors, electro-mechanical clutches, and the like; furthermore, various known means of controller and programming means (whether microprocessor based, analog, digital, electric, mechanic, etc.) can be employed to enable manual, automatic, or pre-programmed levels and routines of adjustable resistance to such resistance means, so as to conform to different user body shapes, sizes, fitness levels and fitness goals, as well as adding programmed routines where the resistances ramp up and down according to different circuits, programs, timetables, simulations, or training philosophies.

Additionally, the angles and lengths of the vertical posts and exercise arms as well as the lengths of the flexible lines and the heights that the exercise units and hip and buttocks pads attach to the vertical posts, can be either manually or automatically adjusted using (or optionally replaced with) any known suitable means of effecting fixed or adjustable location, angle and length, such as pneumatic means, hydraulic means, magnetic, electric, frictional, servo motors, electro-mechanical clutches, pins, clamps and the like; furthermore, various known means of controller and programming means (whether microprocessor based, analog, digital, electric, mechanic, etc.) can be employed to enable manual, automatic, or pre-programmed settings to such locations, lengths and angles, so as to conform to different user body shapes, sizes, fitness levels and fitness goals, and allowing the stance/posture of the user to change automatically to accommodate the varying load demands of different circuits, programs, timetables, simulations, or training philosophies.

Method of Use

Figure 4:
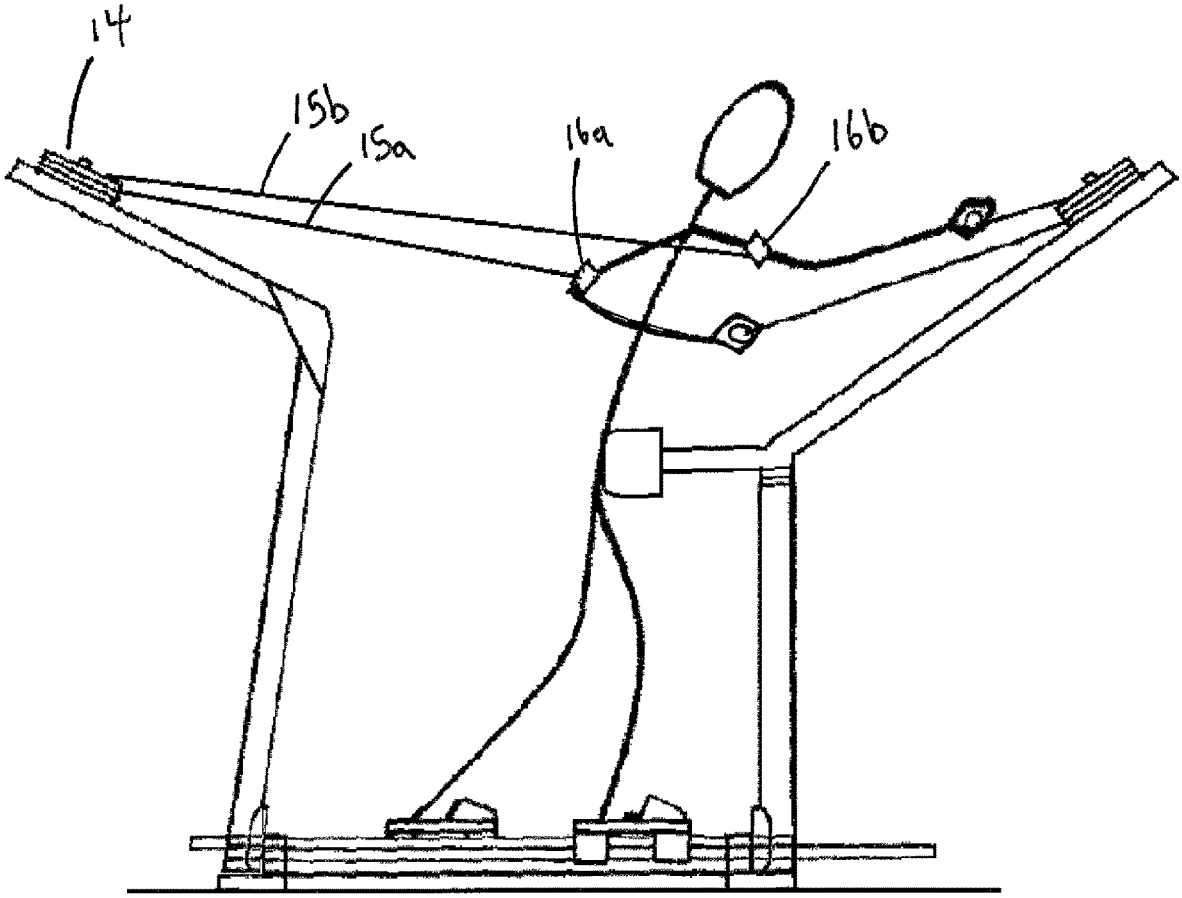
FIG. 4 is a schematic side view of a user using the machine depicted in FIG. 2 above.

In use, the embodiment of this invention depicted in FIG. 4 operates somewhat similar to the prior art NORDICTRACK™ ski machine, with the additional "pushing arms forward against a resistance" feature afforded by the attaching of the rear flexible lines 15*a* and 15*b* to the user's arms (or elbows, forearms, wrists, hands, etc.) by the VELCRO™ Hook and Eye straps 16*a* and 16*b*. According to this invention, a preferred and optimal point of positioning the VELCRO™ Hook and Eye straps 16*a* and 16*b* (for attaching the rear flexible lines 15*a* and 15*b*) is just above the elbow of the user.

In the configuration depicted in FIG. 4, the user preferably adjusts the balance between the pushing resistance versus pulling resistance at the arm level. By doing this, the user is able to effect fine control on the load applied to the front and rear planes of the user's upper body, so as to be able to condition/strengthen whichever muscle groups/areas might need conditioning/strengthening, and so as to be able to avoid overloading other muscle groups/areas which might require rest and recovery. According to the manner in which the present invention works, the upper front resistance load and the upper rear resistance load, so attached to the user's arms, are combined into what can be called the "upper body movement circuit" or "upper body resistance circuit" or "upper circuit" or "upper body circuit."

It was unexpectedly discovered by the inventor that the adjustments enabled by the present invention allow the user to achieve a state of optimal balance and stability in the "upper body resistance circuit", characterized by a natural feel in its movement and in its effects. A properly balanced "upper body resistance circuit" works almost all of the upper body muscles in a way that optimally improves the development and shape of such muscles. For example, regularly using the prior art NORDICTRACK™ ski machine with "upper body resistance circuit" added as in this invention:

- improves the size, shape and conditioning of most of the upper body muscles including the muscles in the mid-section such as the abdominals and obliques,
- improves the structure and stability of the shoulder joint, which improves the aesthetics of the whole area, especially the back region in this area, while reducing susceptibility to Shoulder Impingement Syndrome;
- strengthens the stabilizer muscles that run along the spine, without causing undue flexion, extension and twisting of the spine.

In addition to the advantages listed above, the user can also achieve extreme cardio workout targets almost entirely through the "upper body resistance circuit" exercise. Simply by significantly increasing the upper front and upper rear resistance loads, high levels of demand on the cardiovascular system are possible according to the present invention.

In a preferred embodiment of the present invention, the front resistance pulley and the rear resistance pulley 14 are in the nature of a "direct drive resistance mechanism" whereby, upon pulling back on the flexible line with the left hand, the right hand is pulled forward without any "give" in the flexible line or in the pulley/clutch mechanism of the front arm unit (the flexible lines are called "flexible" herein just because they can bend laterally). The flexible lines have preferably zero (or very little) stretch to them. As the right hand moves forward the rear arm unit 25 creates a "pulling" resistance on the right hand (arm), which has to "push" forward so that the left hand (arm) doesn't have to provide all of the force to move both the front and rear pulleys. It is this counter balance between opposing arms "pushing" and "pulling" that provides the key benefit of this design since the user cannot help but to move in such a way that attempts to minimize the discomfort and effort for any given load. The end result is one where the mind/body connection automatically "works around" most muscle burn issues and operates in a range of motion that is optimum for the shoulder and spine.

Once the user sets up a customized level of front/rear load balance and rear strap tension, no further adjustments should be needed; the invention works without the need for the user to consciously put any extra effort into pushing or pulling or twisting or preventing twisting. If the workout is perceived as being too hard or too easy, adjustment can be made to the front and/or rear resistance pulley/clutch.

The inventor has found that the best configuration for a user is when the front resistance pulley and the rear resistance pulley 14 are set approximately to the same resistance levels, but some users might adjust the front resistance pulley and the rear resistance pulley 14 to different setting so as to fit a particular user's individual circumstances. If the rear resistance pulley/clutch is too tight, there will be extra load placed around the user's biceps (or other attachment point), and if the front resistance pulley/clutch is too tight, the user will have to grip the hand grips excessively hard; both such conditions will lead to early fatigue and discomfort in a specific area.

Figure 5:
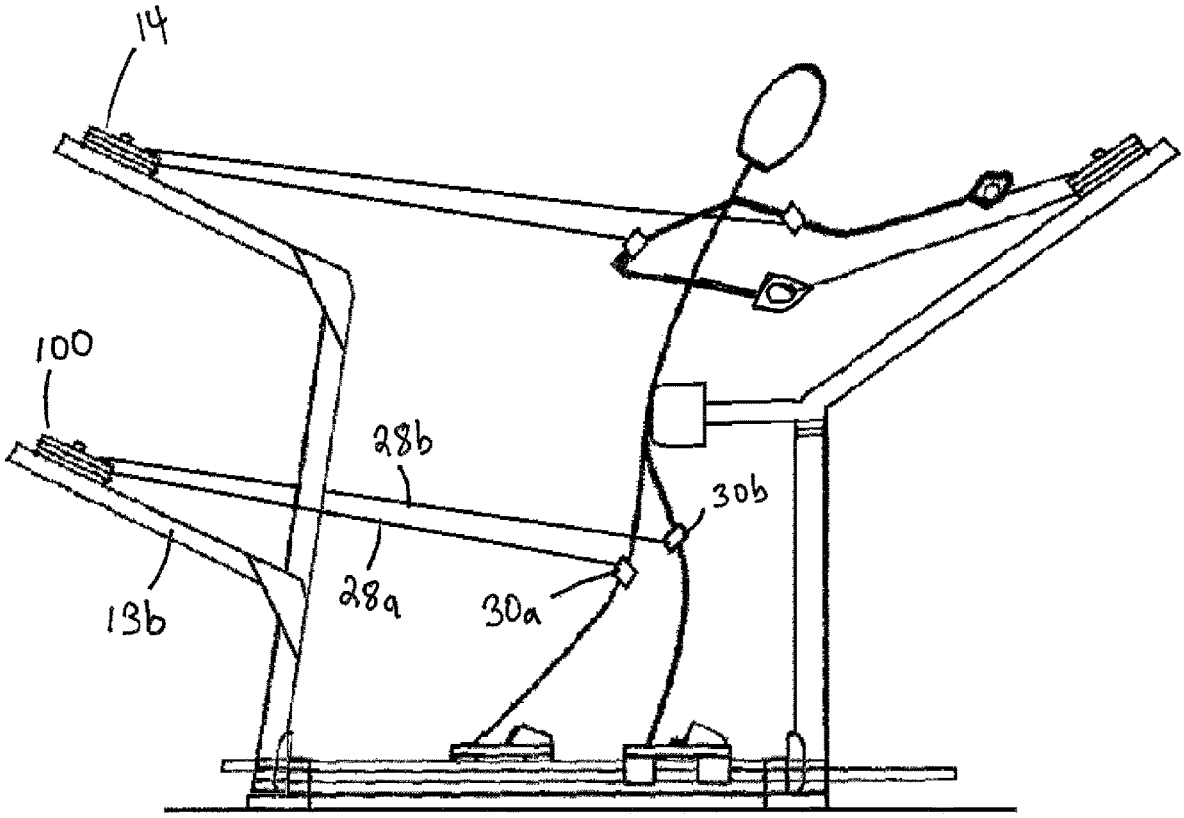
FIG. 5 is a schematic side view of a user using the machine depicted in FIG. 3 above.

Referring now to FIG. 5, to use the embodiment of this invention the user further attaches the rear VELCRO™ Hook and Eye straps 30*a* and 30*b* at the ends of lines 28*a* and 28*b*, respectively, to various parts of the user's lower body (thighs, knees, calves, shins, ankles, shoes, etc.), and adjusts the lower rear resistance pulley 100 to the desired level of resistance to forward pulling, attempting to balance it against the "pushing back" resistance to motion offered by the flywheel and the drag strap of the ski members. A good configuration is preferably achieved when, at the end of a workout session, the user experiences a near perfect balance of muscular soreness/pain/fatigue/exhaustion between all the muscles in the thighs, hamstrings and glutes.

However, the balancing act related to leg workout according to the invention depicted in FIG. 3 is different from the situation (discussed above) related to the inventions action on the upper body through the "upper body circuit". For the leg workout configuration as shown in FIG. 5, there is no "interconnected drive" (left side influencing the right side and vice—versa) like there is for the upper body workout circuit. For the leg workout, the user has, at the bottom of the feet, the resistance to "pushing back", while the resistance to the "leg pushing forward" is preferably applied at (or slightly above) the knee level (where the VELCRO™ Hook and Eye straps 30*a* and 30*b* are preferably applied), so it is obvious that the two resistance forces are not in the same plane like in the upper body circuit.

The inventor has found, unexpectedly, that a very advantageous and comfortable configuration for the leg workout is when there is a small degree of "give" in the bottom leg workout circuit, but without any slack in the rear VELCRO™ Hook and Eye straps 30*a* and 3013, this can preferably be achieved by inserting coil springs between the rear flexible lines 28*a* and 28*b* and the rear VELCRO™ Hook and Eye straps 30*a* and 30*b*. The coil springs maintain a slight but continuous tension on the knee, while allowing some give in the bottom circuit.

During a workout with a preferred embodiment of the present invention, if the user finds that there is too much or too little load on the "upper body circuit", the user can do a quick adjustment by simply adjusting the resistance on the front clutch only. Likewise, if there is an imbalance in fatigue/muscle burn between the upper and lower body, adjustments can be made in either upper or lower loads or both upper and lower loads until an optimum level of balance has been achieved. If training on a day when there is a large amount of fatigue (muscle burn) in the lower body (due to a large volume of recent skating or running or a hard leg workout recently), then the training cadence can be lowered and/or the lower body resistance can be lowered until a comfortable level has been attained, while simultaneously increasing the upper body load to reach the desired overall training effect.

With all other "cardio" machines the inventor has ever used, the principle factors that have limited the amount of exertion and the duration over which this exertion can be expended has never included cardiovascular demand but rather muscle burn and unnaturalness of the body's posture and movement. In marked contrast, when used for "cardio" or Interval Training workouts, the embodiments of the present invention allow the user to ramp the load up to its natural physiological limit (allowing cardiovascular demand to be the primary limiting factor in how much effort can be exerted) while removing the limiting effect of muscle fatigue/burn, as well as removing the structural discomfort (knee, shoulder, hip or back pain) which plague all other prior art "cardio" machines. Even with significant quantities of localized muscular fatigue, with proper adjustment to work around those areas of fatigue, a level of cardiovascular load can be achieved that is far beyond anything possible with any other prior art "cardio" machine.

During a workout with a preferred embodiment of the present invention, the rear arm exercise member of the "upper body circuit" generally needs to be adjusted only if there is a very large change in load required, such as when changing from High Intensity Interval Training style of training to low-intensity steady-state cardio style of training. However, in this case the inventor has found that a change in the height of the exercise units, the angle of the front and rear exercise units and vertical posts as well as the length of the cables is also preferable for very radical changes in training protocol. An analogy would be the difference in posture when running 100 meters versus running 10 km. Ideally these adjustments would be enacted automatically during a users training session when changes in load/resistance and pace/cadence occur.

The inventor has further found, unexpectedly, that, when using this invention, a very advantageous and comfortable preferred configuration for the leg workout can be achieved by replacing the rear resistance pulley 14 with one (or a set of) pneumatic cylinder resistance device(s). Any known pneumatic cylinder resistance devices may be used in various embodiments of the present invention, such as devices similar to the pneumatic resistance components used in the KEISER™ Infinity Functional Trainer. The inventor has access to one of these machines and has successfully used it over an extended period of time to provide the "tension" for the "legs pushing forward" motion with excellent results.

Another major advantage of using pneumatic resistance devices (similar to the ones used in KEISER™ Infinity Functional Trainer) for implementing resistance to "leg pushing forward" in this invention, is the fact that it offers a totally independent load for each of the rear flexible lines 28*a* and 28*b* (unlike the coupled load when the friction resistance pulleys are used). As the left knee of the user pushes forward, it makes no difference to the load on the right knee. The "ski" component of the machine (where a user's feet contact the machine) offers an independent load to each leg. The inventor has further found, unexpectedly, that the use of the pneumatic resistance devices (similar to the ones used in KEISER™ Infinity Functional Trainer) for implementing resistance in this invention makes the machine feel more balanced, with an improved sense of stability.

The inventor has also found, unexpectedly, that the addition of "leg pushing forward" resistance to the leg workout circuit of this machine produces workouts and results to the lower body previously unachievable with the prior art NORDICTRACK™ machine. When using the unmodified prior art NORDICTRACK™ ski machine, the legs perform pre dominantly a "pushing back" motion, which is adequate for cardio and for strengthening those leg muscles used in cross—country skiing. However, any competitive athlete that skates or runs (which covers most of the popular team sports, such as Hockey, Soccer, Baseball, Rugby or Football as well a racket and track sports) would stand to benefit from a "cardio" training regimen which simultaneously improves how quickly one can move one's rear leg back into the forward position, because that is an essential movement which determines how fast one can skate or run. The addition of "leg pushing forward" resistance to the leg workout circuit of this machine seamlessly targets and strengthens the stabilizer muscles between the pelvis and thigh, slightly improving how quickly one can move one's rear leg back into the forward position.

To sum up, the herein described embodiments of this invention have considerable advantages over the prior art NORDICTRACK™ machine, as follows (not a comprehensive list):

1. Increasing the feeling of stability of the user during workouts, allowing harder, more confident and more "comfortable" workouts;
2. Allowing athletes to train to increase forward acceleration and top speed;
3. Allow a greater energy expenditure per unit time of training and, with it, greater cardiovascular fitness;
4. Possibly allow the highest calorie expenditure per unit time of any exercise machine made;
5. Allow a degree of modularity and expandability to the machine; as an example of this "expandability" advantage, one option would be to sell an entry level machine with just the "upper body resistance circuit", while offering the lower "leg pushing forward" feature as an after—market bolt—on kit (including a lower rear arm 13*b*, a lower rear resistance member/pulley/clutch 100, and a pair of rear flexible lines 28*a* and 28*b*, and the additional pair of rear VELCRO™ Hook and Eye straps 30*a* and 306), which the consumer could buy as an upgrade after the purchase of the initial entry level—machine.

As to its construction, embodiments of this invention may be made of any suitable material of sufficient strength and thickness, such as steel, stainless steel, aluminum, other metals, plastic, wood, composite, etc., similar to the existing known materials used for making the prior art NORDICTRACK™ machine.

Any known resistance means can be used to achieve the resistance functionality affected in various embodiments of this invention. For example, the front and rear resistance pulleys can be replaced with any equivalent or known resistance means, such as clutches, or other friction based resistance means, or mechanical, magnetic, pneumatic, hydraulic, electrical, electro—mechanical resistance means, etc. The preferred use of pneumatic resistance devices (functionally similar to the ones used in KEISER™ Infinity Functional Trainer) instead of resistance pulleys, as discussed above, brings about significant advantages to this invention, especially when used for the "Leg Pushing Forward" workout option.

The connections between the base of the machine and the front post and the rear post, and between the posts and exercise units should be made in a sturdy manner, to withstand the loads and shocks expected to occur during use. At the same time, such connections should allow the user to effect, preferably, quick and simple adjustments to the angle of each such connection, to achieve a customized level of comfort. The length of the flexible lines should also preferably be user-adjustable. In other optional embodiments, stretchable lines or cords or ropes may be used instead of the preferred "zero stretch" lines specified in the embodiments described herein.

The VELCRO™ Hook and Eye straps mentioned herein are preferable, but any other known means of attaching the rear flexible lines to the user body can be used, such as: buckle straps, leather straps, sleeves, cuffs, plain straps, loops, nooses, elastic straps, adhesive straps, multi—strap harnesses, special garments fitted with attachment points on arm sleeves and pant legs, etc.

In yet further optional embodiments, the machine could be fitted with more than one rear post and front post, and/or can be fitted with more than one rear arm and one front arm, and/or can be fitted with posts and arms which are branching at some lateral angles (optionally adjustable) from the main back—front axis of the machine. In some other embodiments of this invention, the rear resistance pulleys may not be placed on the machine at all, being mounted instead on a separate self—standing vertical rack or wall; one could then simply position a prior art NORDICTRACK™ machine with the rear in the vicinity of such rack or wall, from where the rear flexible lines can be then accessed and used as rear resistance by a user mounted on the prior art NORDICTRACK™ machine.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as defined in the following claims.

The invention claimed is:

1. An exerciser for simulating cross country skiing comprising:

a base frame having opposite forward and rear ends, a pair of ski members mounted to the base frame, the ski members and base frame configured to permit the ski members to slide back and forth between the forward and rear ends, a front post extending upwardly from the forward end of the base frame, a forward resistance member mounted to the front post, a first flexible line having opposite ends movably coupled to the forward resistance member, the opposite ends of the first flexible line having handles to be gripped by a user's hands to permit the user to reciprocally pull back on the opposite ends of the first flexible line, the forward resistance member configured to apply a second drag force to the first flexible line, a rear post extending upwardly from the rear end of the base frame, a rear resistance member mounted to the rear post, a second flexible line having opposite ends movably coupled to the rear resistance member, the opposite ends of the second flexible line having straps configured to be attached to the user's arms to permit the user to reciprocally pull forward on the opposite ends of the second flexible line, the rear resistance member configured to apply a third drag force to the second flexible line, the ski members being mounted between the forward and rear posts such that the user is positioned between the front and rear posts when the user mounts the ski members.

2. The exerciser of claim 1 wherein:

the forward and rear resistance members comprise first and second pulleys, the first and second flexible lines looping over the first and second pulleys such that the pulleys rotate when the ends of the first and second flexible lines are pulled, respectively.

3. The exerciser of claim 1 further comprising:

a lower rear resistance member mounted to the rear post at a position between the rear resistance member and the base frame, a third flexible line having opposite ends mounted to the lower rear resistance member, the opposite ends of the third flexible line having straps configured to be attached to the user's legs to permit the user to reciprocally pull forward on the opposite ends of the third flexible line, the lower rear resistance member configured to apply a fourth drag force to the third flexible line.

4. The exerciser of claim 3 wherein:

the forward, rear and lower rear resistance members comprise first, second and third pulleys, the first, second and third flexible lines spooling onto the first, second and third pulleys.

5. The exerciser of claim 1 wherein:

the rear resistance member is mounted on a rear arm mounted to and extending away from the rear post.

6. The exerciser of claim 5 wherein:

the forward resistance member is mounted on a forward arm extending away from the forward post, the forward and rear arms extending away from each other.

7. The exerciser of claim 6 wherein:

the lower rear resistance member is mounted on a lower rear arm mounted to and extending away from the rear post, the forward and lower rear arms extending away from each other.

8. The exerciser of claim 7 wherein:

the rear post, the rear arm and the lower rear arm are configured such that the rear resistance member and the lower resistance member can each be selectively positioned relative to the base frame.

9. The exerciser of claim 5 wherein:

the rear post and the rear arm are configured such that the rear resistance member can be selectively positioned relative to the base frame.

10. The exerciser defined in claim 9 wherein:

the rear post meets the base frame at a first angle and wherein the rear arm meets the rear post at a second angle, the base frame, rear post and rear arm being configured to permit the first and second angles to be adjustable.

11. The exerciser defined in claim 1 further comprising:

a buttocks pad mounted to the rear post by an adjustable arm, the adjustable arm positioning the buttocks pad towards the forward end of the base frame, the adjustable arm configured to selectively position the buttocks pad relative to the rear post.

12. An exerciser for simulating cross country skiing comprising:

a base frame having opposite forward and rear ends, a pair of ski members mounted to the base frame, the ski members and base frame configured to permit the ski members to slide back and forth between the forward and rear ends by overcoming a first drag force, a front post extending upwardly from the forward end of the base frame, a forward pair of flexible lines movably mounted to the front post by a front hub, each of the forward pair of flexible lines having handles to be gripped by a user's hands to permit the user to reciprocally pull back on the first pair of flexible lines, the front hub and forward pair of flexible lines being configured such that a second drag force is applied to the first pair of flexible lines resisting the rearward movement of said forward pair of flexible lines, a rear post extending upwardly from the rear end of the base frame, a rear pair of flexible lines movably mounted to the rear post by a first rear hub, the rear pair of flexible lines having straps configured to be attached to the user's arms to permit the user to reciprocally pull forward on the rear pair of flexible lines, the first rear hub and the rear pair of flexible lines being configured such that a third drag force is applied to the rear pair of flexible lines resisting the forward movement of said rear pair of flexible lines, the ski members being mounted between the forward and rear posts such that the user is positioned between the front and rear posts when the user mounts the ski members.

13. The exerciser defined in claim 12 wherein:

the forward and rear pairs of flexible lines comprise first and second elongated flexible lines having opposite ends and the forward and the first rear hubs comprise first and second pulleys rotatably mounted to the forward and rear posts, respectively, the first and second pulleys configured to spool the first and second elongated flexible lines, respectively.

14. The exerciser defined in claim 12 further comprising:

a lower pair of flexible lines movably mounted to the rear post by a lower hub positioned between the base frame and the rear pair of flexible lines, the lower pair of flexible lines having straps configured to be attached to the user's legs to permit the user to reciprocally pull forward on the lower pair of flexible lines, the lower hub and the lower pair of flexible lines being configured such that a fourth drag force is applied to the lower pair of flexible lines resisting the forward movement of said lower pair of flexible lines.

15. The exerciser defined in claim 14 wherein:

the forward pair of flexible lines further comprise a first elongated flexible line, the first elongated flexible line having opposite ends, the rear pair of flexible lines further comprise a second elongated flexible line, the second elongated flexible line having opposite ends, the lower pair of flexible lines further comprise a third elongated flexible line, the third elongated flexible line having opposite ends, and the forward, rear and lower hubs comprise first, second and third pulleys rotatably mounted to the forward and rear posts, respectively, the first, second and third pulleys configured to spool the first, second and third elongated flexible lines, respectively.

16. The exerciser defined in claim 14 wherein:

the first, second, third and fourth drag forces are selectably adjustable.

17. The exerciser defined in claim 12 wherein:

the position of the rear hub relative to the base frame is selectably adjustable.

18. The exerciser defined in claim 12 wherein:

the first, second and third drag forces are selectably adjustable.

19. The exerciser defined in claim 14 wherein:

the positions of the rear and lower hubs relative to the base frame are selectably adjustable.

20. An exerciser for simulating cross country skiing comprising a base frame having opposite forward and rear ends, a pair of ski members mounted to the base frame, the ski members and base frame configured to permit the ski members to slide back and forth between the forward and rear ends by overcoming a first drag force, a front post extending upwardly from the forward end of the base frame, a forward arm exercise unit having a forward pair of flexible lines movably mounted to the front post, each of the forward pair of flexible lines having handles to be gripped by a user's hands to permit the user to reciprocally pull back on the forward pair of flexible lines, the forward arm exercise unit configured such that a second drag force is applied to the forward pair of flexible lines resisting the rearward movement of said forward pair of flexible lines, a rear post extending upwardly from the rear end of the base frame, a rear arm exercise unit having a rear pair of flexible lines, the rear pair of flexible lines having straps configured to be attached to the user's arms to permit the user to reciprocally pull forward on the rear pair of flexible lines, the rear arm exercise unit configured such that a third drag force is applied to the rear pair of flexible lines resisting the forward movement of said rear pair of flexible lines, the ski members being mounted between the forward and rear posts such that the user is positioned between the front and rear posts when the user mounts the ski members.

21. The exerciser defined in claim 20 further comprising:

a leg exercise unit mounted to the rear post, the leg exercise unit having a lower pair of flexible lines, the lower pair of flexible lines having straps configured to be attached to the user's legs to permit the user to reciprocally pull forward on the lower pair of flexible lines, the leg exercise unit configured such that a fourth drag force is applied to the lower pair of flexible lines resisting the forward movement of said lower pair of flexible lines.

22. The exerciser defined in claim 21 wherein:

the second drag force that is applied to the forward pair of flexible lines resisting the rearward movement of said forward pair of flexible lines is applied by a pulley positioned between said forward pair of flexible lines, the third drag force that is applied to the rear pair of flexible lines resisting the forward movement of said rear pair of flexible lines is applied by a pulley positioned between said rear pair of flexible lines, the fourth drag force that is applied to the lower pair of flexible lines resisting the forward movement of said lower pair of flexible lines is applied by a pulley positioned between said lower pair of flexible lines, each pulley being rotatably mounted on the exerciser and provided with means for selectively applying an anti-rotating drag force to each pulley.

* * * * *